United States Patent [19]

Eshleman

[11] 4,093,222

[45] June 6, 1978

[54] MINIATURIZED GOLF GAME

[76] Inventor: Robert C. Eshleman, 221 McAllister, Kentfield, Calif. 94904

[21] Appl. No.: 780,403

[22] Filed: Mar. 23, 1977

[51] Int. Cl.[2] ..... A63F 7/06

[52] U.S. Cl. ..... 273/87 R; 273/180

[58] Field of Search ..... 273/87 R, 87 C, 87.2, 273/134 CG, 129 A, 177 R, 180, 181

[56] References Cited

U.S. PATENT DOCUMENTS

| | | | |
|---|---|---|---|
| 2,243,720 | 5/1941 | Preece | 273/180 X |
| 2,450,125 | 9/1948 | Dunfee | 273/181 R |
| 2,489,676 | 11/1949 | Robinson et al. | 273/87.2 |
| 2,684,849 | 7/1954 | Bakken | 273/87.2 |
| 3,819,185 | 6/1974 | Lowther | 273/134 CG |

FOREIGN PATENT DOCUMENTS

| | | | |
|---|---|---|---|
| 209,999 | 8/1957 | Australia | 273/180 |
| 1,136,652 | 12/1968 | United Kingdom | 273/87.2 |

*Primary Examiner*—Anton O. Oechsle

*Attorney, Agent, or Firm*—Townsend and Townsend

[57] ABSTRACT

A game having a contoured game board on which a miniature game ball is moved by manual manipulation. A map depicting in miniature the playing field of a particlar sport is also provided. Movement of the ball on the contoured board is translated onto the map in scale to simulate the playing of the particular sport on the miniature playing field depicted on the map. According to the preferred embodiment, the particular sport simulated is golf and the present invention allows the playing of golf on any properly scaled miniature golf course map, by making shots on a convexly contoured shot board upon which a struck ball will roll, duplicating the line of flight of a real golf shot, into slots designated as to the distance and direction of the shot depending on the golf club chosen. These slot designations correspond to scaled markers which transfer the shot as to distance and direction onto the properly scaled miniature golf course map. The slots on the shot board also represent holes on the golf course greens and markers on the board determine the difficulty and distance of the putt to be made.

8 Claims, 6 Drawing Figures

MINIATURIZED GOLF GAME

This invention relates to games which simulate in miniature the playing of a sport such as golf.

The present invention provides a contoured game board on which a miniature game ball is moved by manual manipulation. Preferably the manual manipulation of the ball simulates the playing of a particular sport such as golf, in which case a miniature golf ball is struck with a miniature golf club. A flat game field map depicting in miniature a game field for the particular sport is also provided. Movement of the ball on the contoured game board is translated in scale on to the map, to effect a simulation of the playing of the particular sport on the miniature playing field depicted on the map.

According to the preferred embodiment of the present invention, a golf game is provided, employing the same rules of golf, in which golf shots are made on a miniaturized "shot board" convexly contoured to make a ball struck with a miniature club rolling thereupon duplicate the line of flight of a real golf shot. The struck ball rolls into slots arranged along the sides of the horseshoe-shaped shot board each of which slots is denominated with the distance and line of flight of the shot by horseshoe-shaped "distance and direction designators." There is a distance and direction designator representing each of the clubs in a regular golf set and setting out for each club the range of lines of flight and distances possible with each club. The designator is selected prior to the shot being made and placed on the shot board to denominate each slot. The denominated slots correspond to "line of flight arrows" which are scaled to transfer the shot as to distance and direction onto a miniature map of any golf course which is properly scaled to the game. Putting is accomplished on the shot board by determining the distance and location of the player's ball from the hole on the golf course map and placing the ball on the corresponding distance marked on the shot board. The ball is then putted into a slot predesignated on the shot board by a "pin placement disc." These discs are distributed into the slots to designate the location of the slot representing the hole on the golf course which the player is playing.

The objects of the game are as follows:

1. The game requires choice of golf clubs and the knowledge of average golf club ranges and lines of flight associated with each club to choose the distance and direction designators.

2. The game duplicates in miniature on the shot board the exact line of flight a ball takes depending on whether it is properly stroked, simulating the fades, draws, slices, hooks, pushes and pulls of a real golf shot.

3. The game simulates different breaks on a putting green and difficulty of putts, the difficulty depending on the distance of the slot marked on the shot board by a pin placement disc corresponding to the hole being played, the position of the slot on the horseshoe-shaped board, and the width of the particular slot. Discs can be placed to correspond to the difficulty of the green on the holes for the particular course being played according to the position of the slot, and its width.

4. The game familiarizes players with different course layouts which are played in miniature.

5. The game teaches the rules of actual golf by the playing of an actual game on a miniature scale.

6. The game teaches the concentration required in golf through its simulation of the full range of complexity of all aspects of a golf game, requiring correlation of all of these aspects including choosing clubs, the stroking of a ball, and adjusting to the variances in different simulated miniature courses.

All of the above objections of the game were problems of the prior art which are solved by the subject game.

DESCRIPTION OF FIGURES IN DRAWINGS

FIG. 1: A perspective view of the "shot board" with "pin placement discs" laying in various slots of the board, and an exploded view of a "distance and direction designator."

FIG. 2: The three miniaturized golf clubs used to roll the ball along the shot board, a wood, an iron and a putter.

FIG. 3: The "pin placement discs" used to mark the slots on the shot board to designate the pin placement on each of the 18 holes.

FIG. 4: A perspective view of a properly scaled miniature golf course with an exploded view of a line of flight arrow and the manner in which it is placed on the scaled golf course map.

FIG. 5: A view of each of the five line of flight arrows "A" through "E" and the putting measure "P" with an enlarged view of the end of the line of flight arrow "A" showing some of the yardage designations.

FIG. 6: The direction and distance designator for the driver with the yardage distances and letters "A" through "D" corresponding to the line of flight arrows and slots on the shot board.

DETAILED DESCRIPTION OF THE INVENTION

Figure 1:
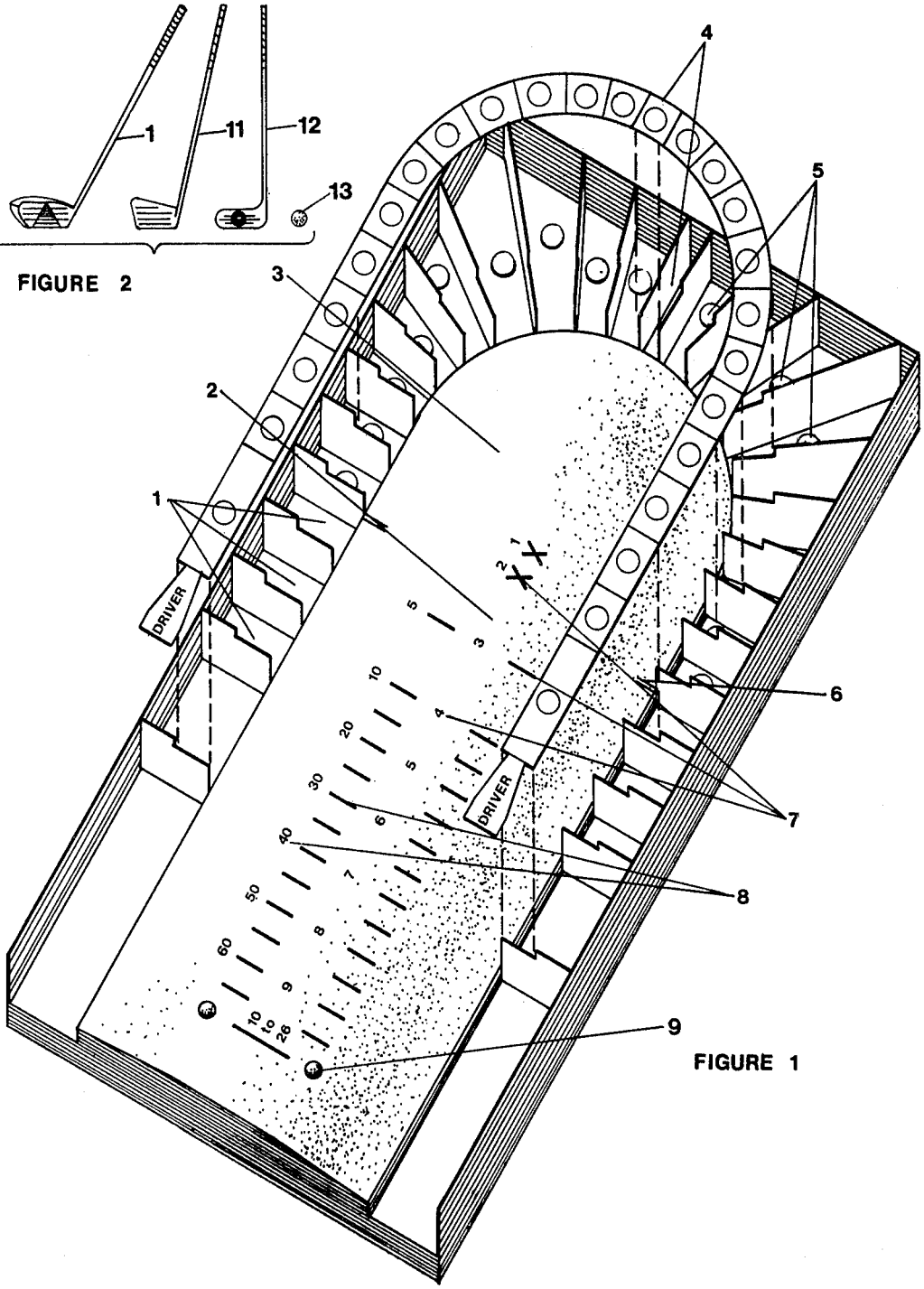

The "shot board" shown in FIG. 1 is comprised of separately partitioned slots 1 on three sides of the board, depressed from the rest of the surface to prevent a ball rolling therein from coming out. These slots open in a horseshoe fashion around a green felt-covered surface. The surface has a flat crest 2 beginning at the open end of the horseshoe and running along approximately three quarters of its length with the crest having a slight downward slope toward the closed end of the horseshoe so that a ball will roll through gravity in that direction along the crest. The board is convexly contoured toward the sides of the horseshoe, and toward the closed end of the horseshoe 3 away from the crest into all of the slots. The slots are equal in number and sufficient width to correspond to "distance and direction designators" which overlay the slots and denominate them 4. The slots, numbering more than 18, are separated and backed by thin partitions so that a ball rolling therein will be stopped and remain. The slots and widths of the opening of the slots onto the horseshoe shaped surface of the board are bilaterally symmetric and decrease in width from the extremely wide slots nearest the open end of the horseshoe 1 to a very narrow slot at the apex of the closed end of the horseshoe 3.

Figure 3:
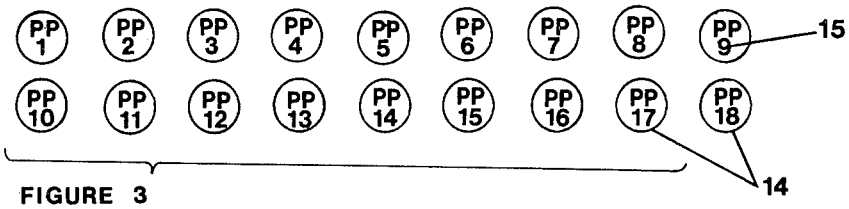

The pin placement discs FIG. 3 are placed in each of eighteen slots around the closed end of the horseshoe nearest its apex 5, excluding the slot at its very apex. These slots are marked off by a double scored line 6 on the shot board surface. The pin placement discs 14 are movable plastic markers with numbers 15 from 1 through 18 to represent the 18 holes of a golf course, and thereby designate each of the 18 slots in which they are placed as the hole for the green on the course numbered on their face.

Figure 2:
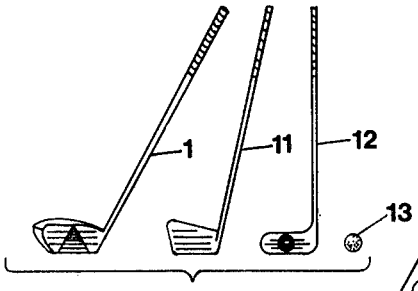

The shot board surface contains numbers and lines 8 representing the number of feet, as measured by the "putt measure" 31 away from the hole on the green of the miniature golf course map 16 where the preceding shot has landed, with numbers running from "5" through "60". The shot board surface additionally contains numbers and lines 7 representing the number of slots on the shot board away from the pin placement disc on the hole which is being played where the second and all succeeding putts are to be taken from if the first putt does not fall into the slot designated by the pin placement disc for that hole, with the numbers running from "1" through "26", 26 representing the total number of slots and thereby the highest number of slots a putt could be distant from the slot with the pin placement disc aimed for. The tee markers 9 on the shot board surface locate where all shots other than putts are to be taken from. The three miniature golf clubs, FIG. 2, consisting of a wood 10, an iron 11, and a putter 12 are used to roll the minature golf ball 13 along the shot board surface according to whether a wood distance and direction designator or an iron distance and direction designator has been chosen for the shot or whether the ball is on the green and a putt is to be made.

Figure 4:
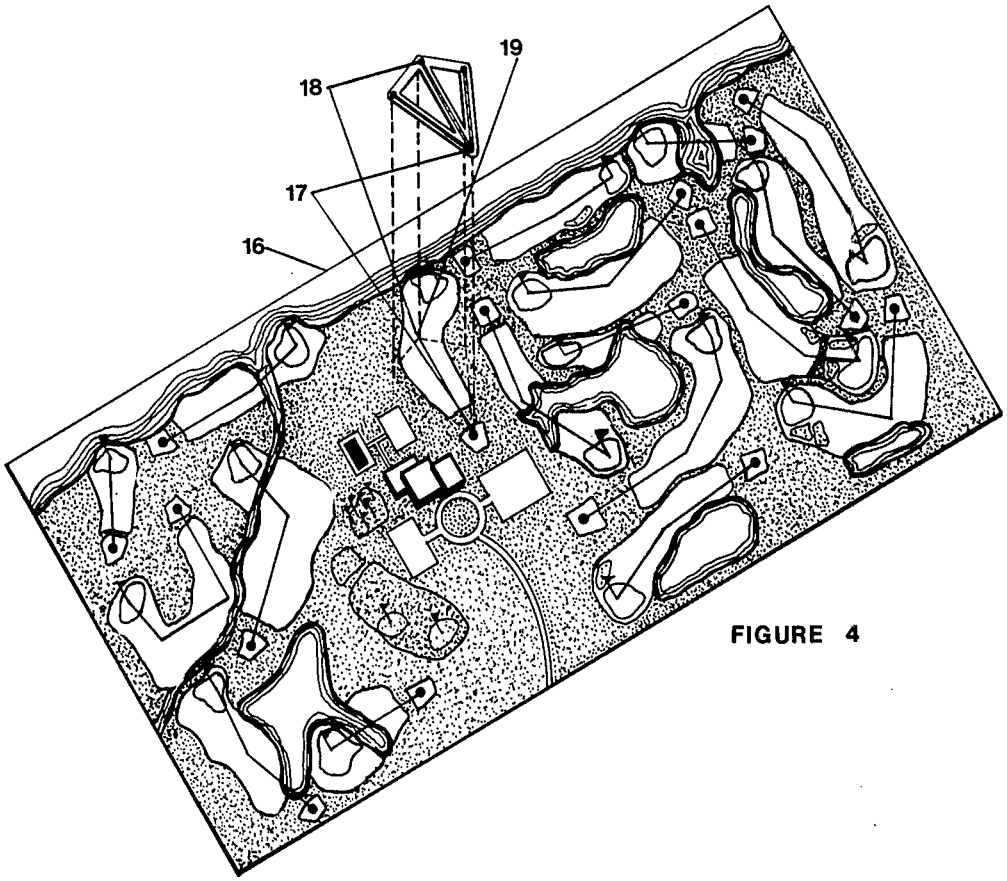

The "miniature golf course map" FIG. 4, 16 may be any map of a golf course scaled to the line of flight arrows with dots marking the tees, and center lines drawn from tee to hole, one for a par three hole, two for a par four hole and three for a par five hold. The course map contains trees, water hazards, sand traps, and all other natural obstacles contained on a regular golf course.

Figure 5:
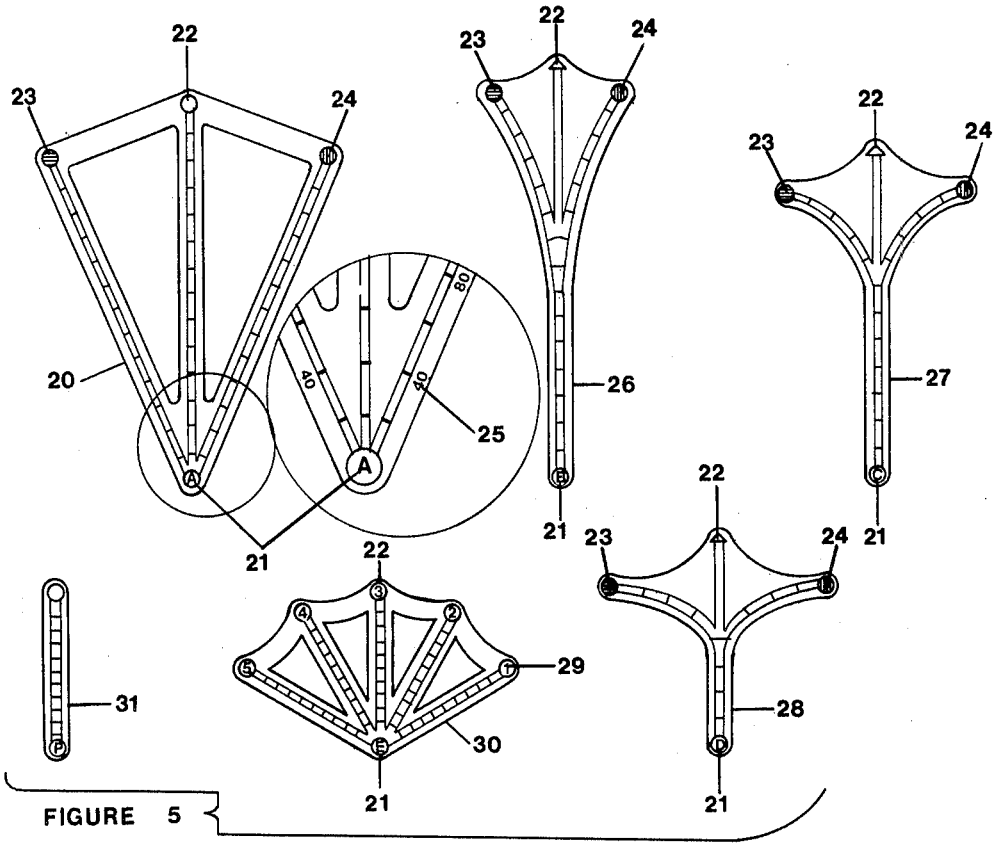

The "line of flight arrows" FIG. 5, numbers 20, 26, 27, 28 and 30 are lettered "A" through "E" 21 and are marked with yardages 25 ranging from 0 yards to 280 yards, depending on the yardage it is possible to achieve with the club chosen for the shot and the direction in which the shot is hit. The scale of the yardages on the line of flight arrows corresponds directly to the scale of the miniature golf course map 16 and the relative curves and lines of flight correspond to the possible range of shots on such a course. The line of flight arrows are made of flat transparent plastic with the lines of flight and yardage markings superimposed so that the whole arrow can be overlayed on the golf course map. The line of flight arrows are lined up by means of their center line 22 and dot at its origin 21 as described below and the shot marked.

Figure 6:
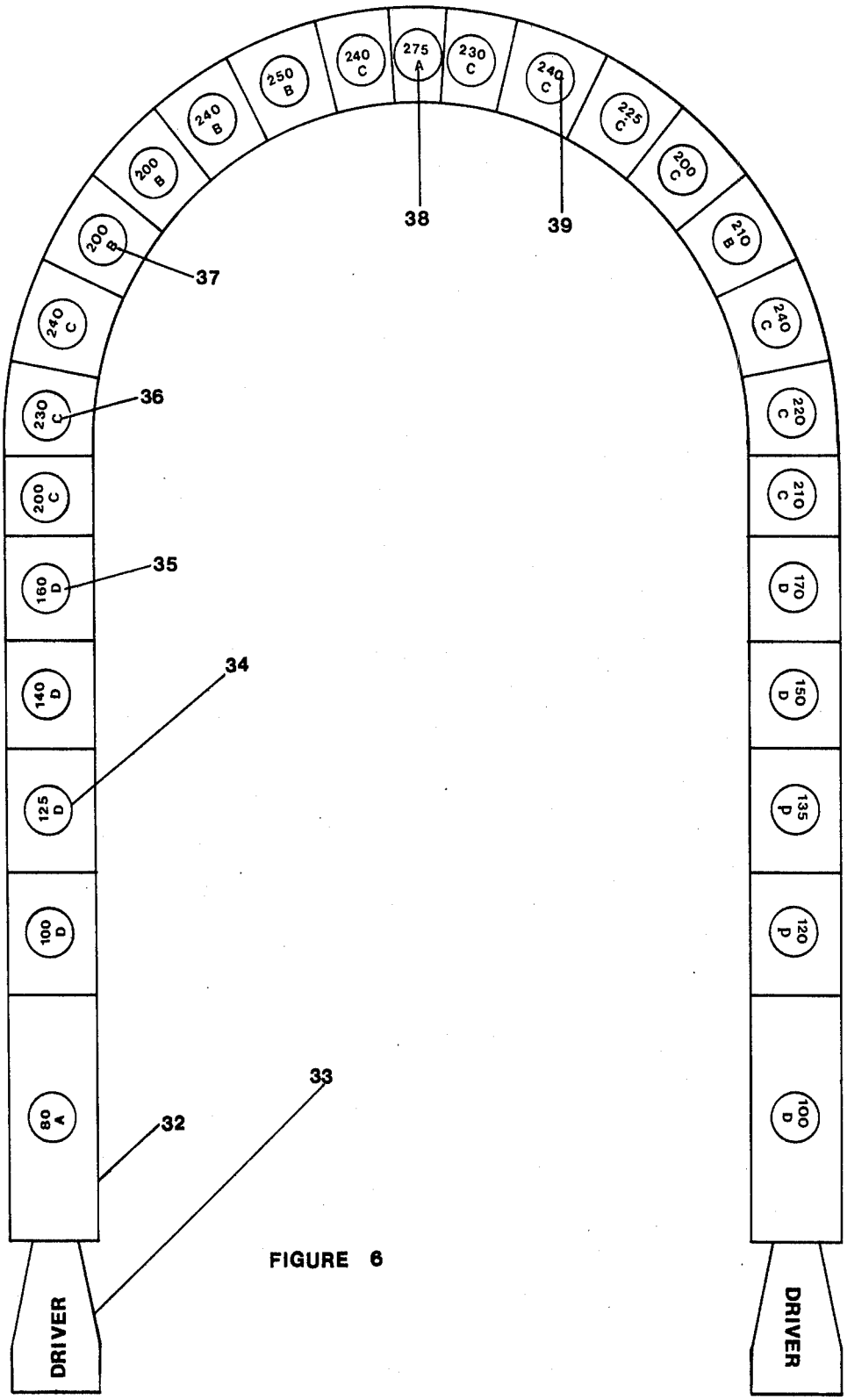

The "distance and direction designators" FIG. 6, number 32 are made of transparent plastic and correspond to each of the golf clubs in a normal golf set 33. They have superimposed on them round denominators for each slot on the shot board 34. These denominators have a letter from "A" through "D" 35, 36, 37, 38 corresponding to one of the letters on a line of flight arrow and a yardage 39 corresponding to a particular yardage on that arrow which is appropriate for the club and direction of the shot.

A special distance and direction designator for chip shots close to the green is marked only with the letter "E" for the special "E" line of flight arrow 30 and the slots on this distance and direction designator are marked with the numbers from 1 through 5, number 29, to determine the direction of the chip as well as yardages as on the other distance and direction designators and line of flight arrows. This special designator has yardages ranging from 0 to 100 yards, corresponding to the yardages possible on chip shots.

The round of golf is begun by choosing for the first shot on the first tee the distance and direction designator corresponding to the club which the golfer desires to use on the first hole and placing it so that the slot designations and circular distance and direction denominators correspond to and line up with the slots on the shot board. The ball is then stroked from between the tee markers along the shot board so that it rolls into one of the slots denominated by the distance and direction designator for the club which has been chosen. The circular denominations on the distance and direction designators falling on the left side of the center of the horseshoe when viewed from the open end are color coded red to indicate a pull or a hook on the ball and to correspond to red dots 23 on the left side of the line of flight arrow. Hence a shot rolling to the left side of the shot board will fall into a slot denominated by a red circle on the distance and direction designator corresponding to the red dot on the line of flight arrow. Likewise, dots to the right side of the center on the distance and direction designator and the right side of the line of flight arrows are designated with dots color coded blue 24 to indicate a push or slice on the ball. The line of flight arrow "A" additionally has, straight down the middle, a white dot indicating a perfectly straight shot, which corresponds to white circles straight down the middle of the distance and direction designators.

After the shot is made on the shot board the line of flight arrow corresponding to the letter denominated on the circle of the distance and direction designator over the slot into which the ball has rolled is placed with its base on the first tee 17 and its middle arrow, or dot placed directly down the line in the middle of the first fairway 18 on the properly scaled miniature golf course map. The proper line of flight according to whether the dot on the distance and direction designator is red, white or blue, and the shot on the shot board was hit to the left, straight or to the right, is picked and the yardage on the circle of the distance and direction designator is marked off on the line of flight arrow. A mark is placed on the golf course surface where the direction on the line of flight and the yardage correspond to the distance and direction designator circle denominating the slot on the shot board into which the ball has rolled.

The second shot as to all par 3 and par 4 holes on the golf course map is transferred to the miniature golf course map by aligning the base of the line of flight arrow with the position of the ball and the center line arrow or dot of the line of flight arrow with the point where the center line of the fairway meets the flag stick on the green 19.

The same procedure is applied to the third shot on par 5 holes. As to the second shot on par 5 holes the shot is transferred to the miniature golf course map by lining up the base of the line of flight arrow with the position of the ball and the arrow or dot at the head of the center line of the line of flight arrow with the point where the second segment of the center line of the fairway meets the third segment. If the line of flight of the shot, as transferred to the miniature golf course map by the line of flight arrow, crosses a tree on the course the ball is marked at the point the shot intersects the tree.

When a shot is marked in a sand trap on the miniature golf course map the next shot is taken employing the same procedure as any other shot except that 25 yards is subtracted from the yardage denominated on the circle of the distance and direction designator for the slot into which the shot is stroked.

The more preferable shots on the shot board as to distance and straightness are placed on the distance and direction designator in the most narrow slots and those slots which because of the convex contour of the shot board are most difficult to reach.

Each player continues to select a distance and direction designator and forward the progress of his ball by making shots on the shot board and transferring them onto the miniature golf course map with the line of flight arrows until the position of his ball reaches the green of the hole being played on the map.

When a player's ball is resting on the green, the distance between the ball and the base of the flag stick on that hole is measured with the putt measure. The player then places his ball at the marking on the shot board corresponding to the distance his ball is from the base of the flag stick and attempts to stroke the ball with the miniature putter into the slot designated with the pin placement disc having on its face the number of the hole which he is playing. If the player strikes the ball into a slot representing the hole he is playing, he has sunk the putt. If the ball is stroked into some other slot, the number of slots distant from the slot having the pin placement disc with the number of the hole he is playing is counted and the ball is placed at the number on the shot board corresponding to the number of slots distant from the proper slot and a second putt toward the proper slot is made from the point. The procedure is repeated until the player rolls the ball into the slot with the proper pin placement disc representing the hole he is playing.

The pin placement discs may either be placed randomly in slots at the beginning of the game, or placed in slots accordingly to the difficulty of the green on the miniature golf course map and the corresponding difficulty of the slots because of their width and position in relation to the convex contour of the shot board.

Since innumerable modifications and variations of the present invention are feasible given the above disclosures, it is therefore to be understood that included within the ambit of the claims, the invention may be practiced otherwise than as specifically described.

What is claimed is:

1. A skill game simulating in miniature the playing of golf comprising:

a miniature golf ball;

a contoured game board having a plurality of slots arranged in a "U"-shaped configuration around a playing area convexly contoured with the apex thereof lying on the centerline of said "U" to arcuately accelerate said ball rolling thereon away from said centerline simulating hook and slice;

designator means for associating golf shots of particular distances and directions with each of said slots, the distances of the golf shots being generally inversely related to the distances from the associated slots to said centerline, the directions of the golf shots associated with the slots on the legs of said "U" being primarily hooks and slices respectively;

at least one miniature golf club for manual striking of said ball for movement on said contoured game board;

a map depicting in miniature a golf course; and scaling means for translating the golf shots associated with said slots into corresponding movement on said map to simulate the playing of golf on the course depicted on said map by skilled manual manipulation of said ball on said contoured game board.

2. Apparatus according to claim 1 wherein said designator means comprises at least one generally U-shaped distance and direction designator adapted to be disposed adjacent said contoured game board carrying indicia associated with each of said slots.

3. Apparatus according to claim 1 wherein the width of each of said slots corresponds to the difficulty of making the particular golf shot associated with each of said slots.

4. Apparatus according to claim 1 wherein said scaling means comprises at least one line of flight arrow indicator bearing a plurality of indicia representative of golf shots of varying direction and distance corresponding to the golf shots defined by said designator means.

5. Apparatus according to claim 4 wherein at least one of said line of flight arrow indicators defines a linear scale and a pair of curved outwardly diverging scales disposed on either side of said linear scale to define lines of flight corresponding to a straight shot, a hook and a slice, respectively.

6. Apparatus according to claim 1 comprising a plurality of indicia representative of each of the holes of the golf course, said indicia being disposed adjacent to said slots to associate each slot with a particular hole on the golf course, the golf ball being manipulated into the slot associated with the desired hole on the golf course to simulate putting.

7. Apparatus according to claim 6 wherein said indicia are carried on interchangeable markers to permit the particular holes associated with the slots to be varied.

8. Apparatus according to claim 6 wherein the contoured playing area of said contoured game board includes scaled distance indicia defining the distance from the golf ball to the golf hole for purposes of putting.

* * * * *